US008550176B2

(12) United States Patent
Knobloch, Jr. et al.

(10) Patent No.: US 8,550,176 B2
(45) Date of Patent: Oct. 8, 2013

(54) WELLBORE BYPASS TOOL AND RELATED METHODS OF USE

(75) Inventors: Benton T. Knobloch, Jr., Broussard, LA (US); Todd J. Roy, Youngsville, LA (US); David J. Tilley, Franklin, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 354 days.

(21) Appl. No.: 13/023,224

(22) Filed: Feb. 8, 2011

(65) Prior Publication Data

US 2011/0203809 A1 Aug. 25, 2011

Related U.S. Application Data

(60) Provisional application No. 61/302,583, filed on Feb. 9, 2010.

(51) Int. Cl.
*E21B 34/12* (2006.01)

(52) U.S. Cl.
USPC ..... 166/386; 166/334.1

(58) Field of Classification Search
USPC ..... 166/386, 334.1, 373, 318, 334.4
See application file for complete search history.

(56) References Cited

U.S. PATENT DOCUMENTS

| | | | | |
|---|---|---|---|---|
| 2,616,502 | A | 11/1952 | Lenz | |
| 3,054,415 | A * | 9/1962 | Baker et al. | 137/68.16 |
| 4,074,761 | A | 2/1978 | Mott | |
| 4,315,542 | A | 2/1982 | Dockins, Jr. | |
| 4,365,671 | A | 12/1982 | Long | |
| 4,531,891 | A | 7/1985 | Coles, III | |
| 5,048,611 | A | 9/1991 | Cochran | |
| 5,176,216 | A | 1/1993 | Slater et al. | |
| 6,065,541 | A | 5/2000 | Allen | |
| 6,102,060 | A | 8/2000 | Howlett et al. | |
| 6,152,228 | A | 11/2000 | Carmichael | |
| 6,220,357 | B1 | 4/2001 | Carmichael et al. | |

(Continued)

FOREIGN PATENT DOCUMENTS

| | | |
|---|---|---|
| EP | 0692610 A2 | 1/1996 |
| GB | 2272923 A | 6/1994 |

(Continued)

OTHER PUBLICATIONS

MI Swaco, 2008 Catalog Specialized Tools, 2008, pp. 1-59, M-I L.L.C., Houston, Texas.

(Continued)

*Primary Examiner* — Daniel P Stephenson
(74) *Attorney, Agent, or Firm* — Booth Albanesi Schroeder LLC

(57) ABSTRACT

Disclosed is a bypass tool for a tubing string a wellbore. The bypass tool has a tubular body with ports in the body wall to inject fluid into an annulus. An axially shiftable sleeve is mounted to control flow through the ports. Spring-loaded detents in the body engage openings in the sleeve. In operation, the bypass tool is run into the wellbore in the closed position with the sleeve closing the ports. When bypass flow is desired, an actuation ball is pumped down the wellbore and engages the detents, unlocking the sleeve to shift to where ports in the sleeve align with ports in the mandrel. To return the bypass tool to the closed position, a second ball of the same diameter as the first ball is pumped down the well to engage and depress the detents to allow the sleeve to shift to a closed position.

20 Claims, 10 Drawing Sheets

(56) References Cited

U.S. PATENT DOCUMENTS

| | | | | |
|---|---|---|---|---|
| 6,227,291 | B1 | 5/2001 | Carmichael et al. | |
| 6,253,861 | B1 | 7/2001 | Carmichael et al. | |
| 6,279,657 | B1 | 8/2001 | Carmichael et al. | |
| 6,318,470 | B1 * | 11/2001 | Chang et al. | 166/377 |
| 6,343,648 | B1 | 2/2002 | Carmichael et al. | |
| 6,609,569 | B2 * | 8/2003 | Howlett et al. | 166/264 |
| 6,655,462 | B1 | 12/2003 | Carmichael et al. | |
| 6,877,566 | B2 * | 4/2005 | Sellinger et al. | 166/373 |
| 7,096,950 | B2 | 8/2006 | Howlett et al. | |
| 7,108,083 | B2 | 9/2006 | Simonds et al. | |
| 7,150,326 | B2 | 12/2006 | Bishop et al. | |
| 7,311,141 | B2 | 12/2007 | Tulloch et al. | |
| 7,318,478 | B2 | 1/2008 | Royer | |
| 7,347,288 | B2 | 3/2008 | Lee | |
| 7,383,881 | B2 | 6/2008 | Telfer | |
| 7,500,526 | B2 | 3/2009 | Telfer | |
| 7,628,213 | B2 * | 12/2009 | Telfer | 166/381 |
| 7,637,323 | B2 | 12/2009 | Schasteen et al. | |
| 8,215,401 | B2 * | 7/2012 | Braekke et al. | 166/318 |
| 2009/0056952 | A1 | 3/2009 | Churchill | |
| 2010/0252276 | A1 | 10/2010 | Clausen et al. | |
| 2011/0011588 | A1 | 1/2011 | Melder et al. | |
| 2011/0048723 | A1 | 3/2011 | Edwards | |

FOREIGN PATENT DOCUMENTS

| | | | |
|---|---|---|---|
| GB | 2309470 | A | 7/1997 |
| GB | 2323111 | A | 9/1998 |
| GB | 2325682 | A | 12/1998 |
| GB | 2339814 | B | 8/2002 |
| GB | 2341405 | B | 9/2002 |
| GB | 2342666 | B | 1/2003 |
| WO | 03089755 | A1 | 10/2003 |
| WO | 2008139132 | A1 | 11/2008 |
| WO | 2011028558 | A2 | 3/2011 |
| WO | 2011028563 | A2 | 3/2011 |

OTHER PUBLICATIONS

PCT International Search Report, PCT/US2010/045456, issued Mar. 31, 2011.

*M-I, LLC* v. *Chad Lee Stelly, et al*., In the United States District Court for the Southern District of Texas, Houston Division, C.A. No. 4:09-CV-01552, Third Amended Complaint (Exhibits A-G were designated Attorney Eyes Only at time of filing and have been removed), Sep. 7, 2010.

*M-I, LLC* v. *Chad Lee Stelly, et al*., In the United States District Court for the Southern District of Texas, Houston Division, C.A. No. 4:09-CV-01552, Answer and Counterclaims to Plaintiff's Third Amended Complaint, Jan. 28, 2011.

*M-I, LLC* v. *Chad Lee Stelly, et al*., In the United States District Court for the Southern District of Texas, Houston Division, C.A. No. 4:09-CV-01552, Order of Dismissal with Prejudice, Jun. 28, 2012.

* cited by examiner

WELLBORE BYPASS TOOL AND RELATED METHODS OF USE

CROSS REFERENCE TO RELATED APPLICATIONS

This application claims priority from U.S. Provisional Patent Application No. 61/302,583, filed Feb. 9, 2010, entitled "Bypass Tool," which is hereby incorporated by reference in its entirety.

BACKGROUND

Technical Field

The present inventions relate, generally, to apparatus and methods used in well servicing, such as oil and gas wells. More specifically, these inventions relate to downhole apparatus which is used to provide a flow passage from a tubular string into the annulus between the tubular string and the casing in which it is run.

As is common in the art, nozzles or ports are utilized to inject fluid into the annulus surrounding a tubing string to clean various components in the wellbore. For example, cleaning of subsea surfaces and profiles of subsea wellheads, blowout preventers ("BOPs") and the like, using fluid directed at the surface or "jetted" thereon; "lifting" fluid located above liner tops and the like (to increase annular flow); and various other operations. In other applications, fluids are injected into the annulus to assist circulation. As is known in the relevant art, such tools are typically run into a cased wellbore on a tubular string, which may be of tubing, drill pipe or the like, referred to herein as a "tubing string."

The efficient operation of nozzles requires the presence of a means for controlling flow through the nozzles. A mandrel with an axially or rotatable valve element has been used to control fluid flow to the nozzles. For purposes of this application, the apparatus may be referred to, at times, as a "bypass tool."

Exemplary, non-limiting embodiments and/or disclosures of bypass tools are disclosed in: U.S. Pat. Nos. 6,065,541; 6,253,861; 6,877,566; and 7,150,326, the contents of which are hereby incorporated by reference, as if they were presented herein in their entirety. However, the art field is still in search of satisfactory wellbore bypass tools.

SUMMARY OF THE INVENTIONS

Disclosed is a bypass tool for connection in a tubing string suspended in a subterranean location in a wellbore 102 for use in methods. The bypass tool has a tubular body for connection to a tubing string with ports in the body wall to inject fluid into the annulus surrounding the tubing string. In some applications, nozzles are placed in the ports to create fluid jets which can be utilized, for example, for cleaning a subsea BOP. In other applications, fluids are injected into the annulus to assist in starting and maintaining circulation. An axially shiftable sleeve is mounted in the body's internal bore and acts as a valve to open and block flow through the ports. Spring-loaded detents in the body engage openings in the sleeve to lock the sleeve against axial movement. The detents extend into the sleeve to be engaged by an actuator ball pumped down the tubing string to the bypass tool. In operation, the bypass tool is run into the wellbore 102 in the closed position with the sleeve closing the ports in the mandrel. When bypass flow is desired, an actuation ball is pumped down the wellbore 102 to the bypass tool. The ball engages a seat in the sleeve to obstruct flow down the tubing string. The ball also engages and depresses the detents, unlocking the sleeve to shift axially down the wellbore 102 to the bypass position where ports in the sleeve align with ports in the mandrel to permit flow through the ports. To return the bypass tool to the closed position, a second ball of the same diameter as the first ball is pumped down the well to abut the first ball and engage and depress the detents to allow the sleeve to shift to a closed position. In this closed position, flow through the tubing string is reopened by shifting the ball-seat assembly to an enlarged area of the mandrel bore where fluid is free to flow around the ball seat.

These and other features and advantages of the inventions will be apparent to those skilled in the art from the following detailed description of a preferred embodiment, taken together with the accompanying figures and claims.

BRIEF DESCRIPTION OF THE FIGURES

In order that the manner in which the above recited and other advantages and objects of the inventions are obtained, a more particular description of the inventions briefly described above will be rendered by reference to specific embodiments thereof, which are illustrated, in the appended drawings. All figures of the present inventions are not drawn to scale unless otherwise indicated. Understanding that these drawings depict only typical embodiments of the inventions and are therefore not to be considered limiting of the scope of the inventions, the inventions will be described with additional specificity and detail through the use of the accompanying drawings in which.

DETAILED DESCRIPTION OF THE INVENTIONS

The particulars details shown herein are by way of example and for purposes of illustrative discussion of the preferred embodiments of the present inventions. The details are presented to provide the most useful and readily understood description of the principles and conceptual aspects of various embodiments of the inventions. In this regard, no attempt is made to show more structural details of the inventions than necessary for the fundamental understanding of the inventions, the description taken with the drawings making apparent to those skilled in the art how the several forms of the inventions may be embodied and practiced.

The following definitions and explanations are meant and intended to be controlling in any future construction unless clearly and unambiguously modified in the following description or when application of the meaning renders any construction meaningless or essentially meaningless. In cases where the construction of the term would render it meaningless or essentially meaningless, the definition should be taken from Webster's Dictionary, 3$^{rd}$ Edition. Definitions and/or interpretations should not be incorporated from other patent applications, patents, or publications, related or not, unless specifically stated in this specification or if the incorporation is necessary for maintaining validity.

As used herein, the term "attached" or any conjugation thereof, describes and refers to the at least partial connection of two items.

As used herein, the term "integral" means and refers to lacking nothing essential after assembly.

As used herein, a "fluid" is a continuous, amorphous substance whose molecules move freely past one another and that has the tendency to assume the shape of its container, for example, a liquid or a gas.

Other than in the operating examples, or where otherwise indicated, all numbers expressing quantities of components used herein are to be understood as modified in all instances by the term "about."

As used herein, the words "comprise," "have," "include," and all grammatical variations thereof are each intended to have an open, non-limiting meaning that does not exclude additional elements or steps. The terms "up" and "down" are used herein to refer to the directions along the wellbore 102 toward and away from the wellhead and not to gravitational directions. The term "tubing string" is used herein to refer to coil tubing, tubing, drill pipe or other tool deployment strings.

Figure 1A:
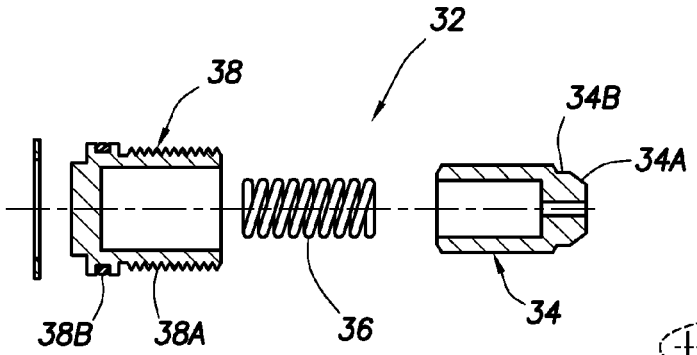
FIG. 1A is an enlarged, exploded sectional view of a detent assembly of the embodiment of FIG. 1.
Figure 1B:
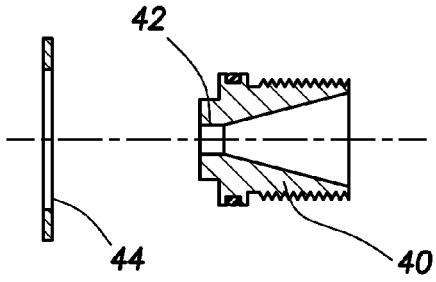
FIG. 1B is an enlarged, exploded sectional view of a jet of the embodiment of FIG. 1.
Figure 1:
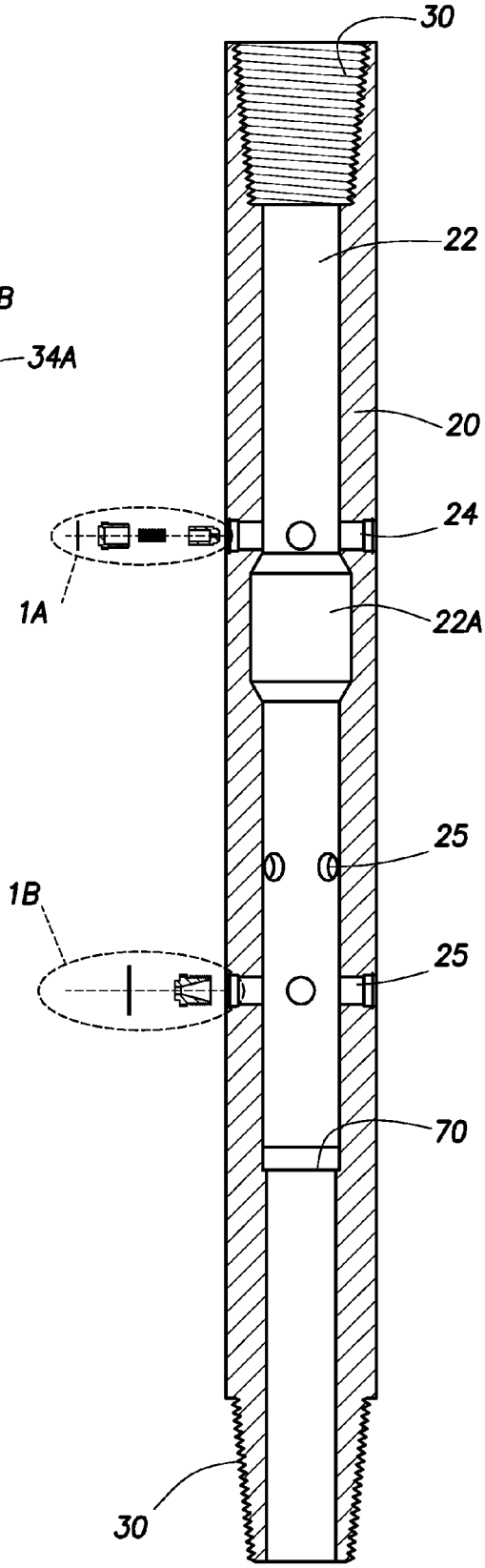
FIG. 1 is a sectional view of the main body of one embodiment of the present inventions.

Referring now to the drawings, wherein like reference characters refer to like or corresponding parts throughout the several views, there is illustrated in FIG. 1, a bypass tool 10 comprising a main body 20, preferably with a means (threaded connection 30) for attachment to a tubing string at its upper end and another threaded connection 30 at the lower end. Main body 20 has a longitudinal bore 22 extending therethrough, with an enlarged bore section 22A. The enlarged bore section 22A is, as will be described, present to permit fluid flow around an activating member, such as a ball, dart, spear or the like.

Tubular main body 20 has a plurality of holes or ports 24 and 25 through the wall of the body. Ports 24 are internally threaded to mount detent assemblies 32 therein. As illustrated in FIG. 1A, detent assemblies 32 comprise detent pins 34, springs 36, and caps 38. The caps 38 are threaded to mount in ports 24. Other mounting arrangements are envisioned such as snap rings or pins. Caps 38 have external annular-shaped seals 38B to close off the ports 24. Ports 25 may have jets 40 mounted therein. One embodiment of the jets 40 has an internal passageway 42 and an external annular seal 44 to seal around the jet. A retainer or snap ring 46 mounts the jets 40 in ports 25, but it is envisioned that threads or other mounting means could be used.

Figure 2:
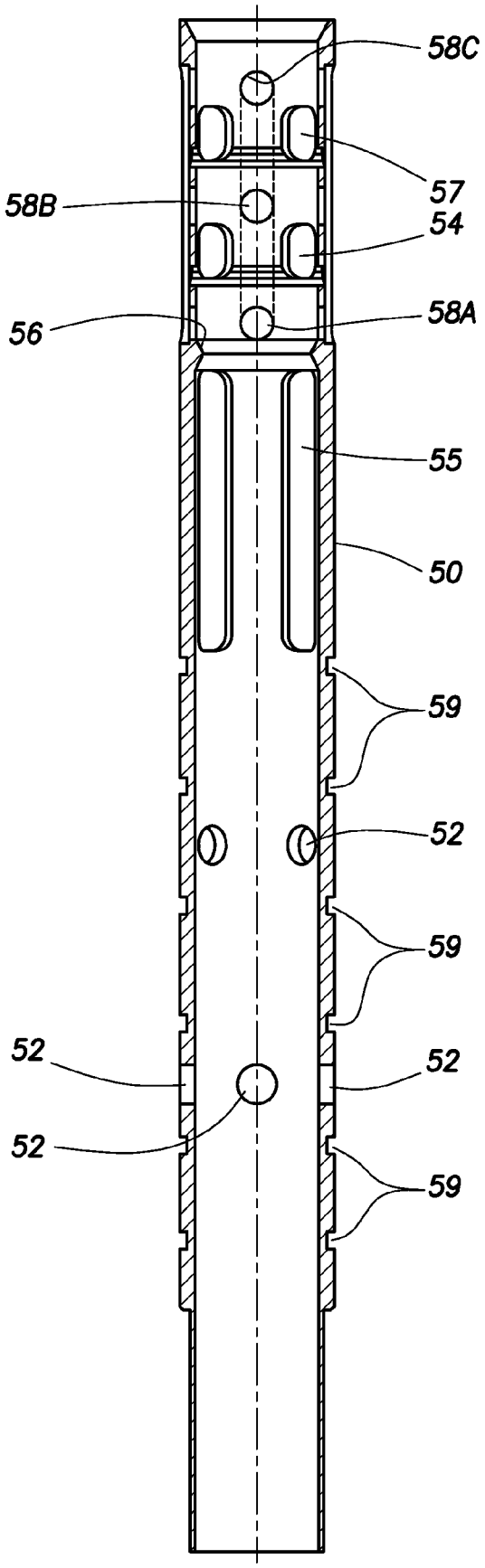
FIG. 2 is a sectional view of the inner sleeve of an embodiment of the present inventions.
Figure 3:
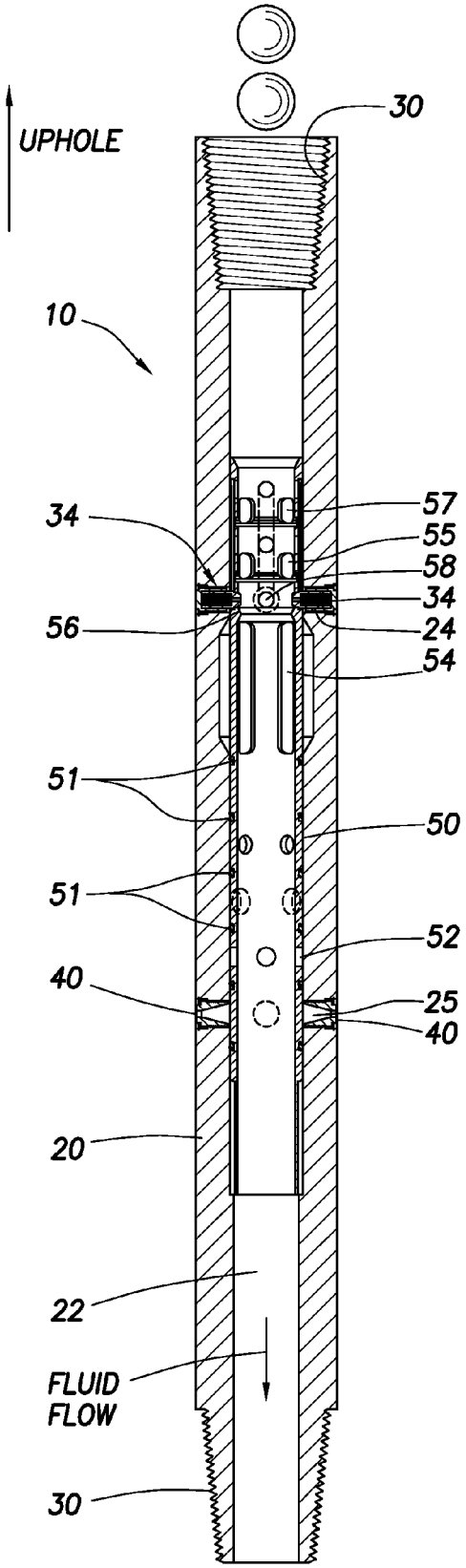
FIG. 3 is a sectional view of one embodiment of the bypass tool of the present inventions in a first or closed position with the ports blocked and wherein fluid is being pumped through the tubing string flows through the bypass tool.

Turning now to FIG. 2, a generally cylindrical inner sleeve 50 is illustrated. The sleeve is of a size and shape to telescope into longitudinal bore 22 of main body 20 as is illustrated in FIG. 3. In the preferred embodiment illustrated, inner sleeve 50 has a plurality of holes or ports 52, through which fluids flow when the tool is in the bypass position; a plurality of slots 54*a* and 54B, through which fluids flow when an activating member is in place on the inner sleeve seat; a ball seat 56 to accommodate an activating member; a plurality of detent pin receiving holes 58A, 58B and 59C, into which detent pins 34 fit; and a plurality of annular slots 59 for receiving annular seal elements 51. Holes 58A-C are frustro conical shaped with the sides sloping outward at 30 to 45 degrees from center. As will be explained, this will aid in forcing the pins 34 outward when contacted by an actuation member.

Figure 9:
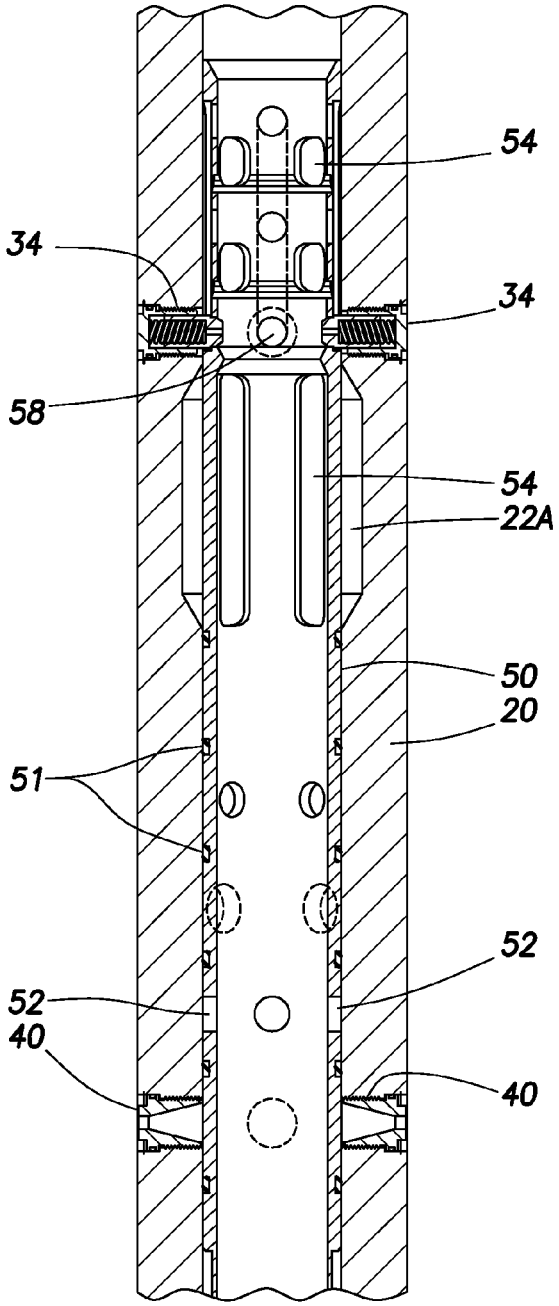
FIG. 9 is an enlarged, partial sectional view of one embodiment of the bypass tool of the present inventions in a first or closed position with the ports blocked and wherein fluid is being pumped through the tubing string flows through the bypass tool.

In FIGS. 3 and 9, the bypass tool 10 is illustrated assembled and in the closed position as it would be moved into position in the well. In the closed position, the inner sleeve is held in position by detents pins 34, engaging the lower detent pin receiving holes 58A. As can be seen, seals 51 are mounted in slots 59 to seal off the ports 25 from the ports 52. Preferably, seal elements 51 are O-rings, packing or similar seal elements, creating a fluid seal between inner sleeve 50 and the inner longitudinal bore 22 of main body 20. In this position, the bypass tool 10 can be assembled in a tubing string, such as a drill string, and well fluid flowing in the string will circulate through the longitudinal bore 22 of the bypass tool 10 without loss through the body wall. It is to be understood, of course, that bypass tool 10 may be run into a wellbore 102 in either the circulating or bypass position.

The operation of the bypass tool 10 will be described by reference to FIG. 3-14. The figures illustrate section views of an assembled bypass tool 10 in various operating positions. Additional detail regarding the structure of the bypass tool 10 and its operation can be best described with reference to those drawings. It is to be understood that certain element numbers are omitted from some of the drawings, for clarity. As described, the inner sleeve 50 is disposed within longitudinal bore 22 of main body 20, and is capable of shifting axially therein between. In this particular embodiment, the sleeve is moveable into three positions: an uppermost or first circulating position, illustrated in FIGS. 3 and 9, with the bypass port 25 and jets 40 blocked; an intermediate or bypass position, illustrated in FIGS. 6 and 12; and a lowermost or second circulating position, illustrated in FIGS. 8 and 14. It is to be understood that references to "uppermost" and "lowermost" are relative to the tool's orientation in a wellbore 102, which is as shown in the drawings, with the uphole direction indicated.

Other structural features of bypass tool 10 and how the various parts interact with one another can be described by a description of the operation of bypass tool 10, with reference particularly to FIGS. 3-14. In FIG. 3, the bypass tool 10 is illustrated in the first or circulating position, that is, no fluid path or bypass exists from the bore of the apparatus to the annulus. While, as mentioned above, the tool may be run into a wellbore 102 in either the circulating or the bypass position, in the illustrated and described example, the tool is run into the wellbore 102 in the first circulating position.

The position shown in FIG. 3, inner sleeve 20 is in an upper or first circulating position with the bypass ports closed. In this position, ports 52 in inner sleeve 50 are not aligned with ports 25 in main body 20, thereby preventing fluid passage from the bore 22 of the bypass tool, out through ports 52 in inner sleeve 50, and through jets 40 disposed in ports 25. Fluid flowing through the tubing string is directed through the bore of inner sleeve 50 and downhole through the tubing string located below the tool 10.

Detent pins 34, biased radially inward by springs 36, protrude through detent pin receiving holes 58 in inner sleeve 50, thereby holding inner sleeve 50 in position. In the illustrated embodiment, detent assembly 32 is positioned in main body 20 (although, as later described, detent assembly 32 could be carried by inner sleeve 50). In the position shown in FIG. 3, detent pins 34 extend into lower detent pin receiving holes 58A. The detent pins 34 are biased radially inward by springs 36, thereby providing a detent function and pinning or maintaining inner sleeve 50 in a given position. As can be seen in more detail in FIG. 1A, detent pins 34 have an angled or tapered nose section 34A, and a square shoulder section 34B. As long as detent pins 34 protrude far enough through detent pin receiving holes 58A, such that, the square shoulder sections 34B are in said hole, then a positive interference engagement exists, i.e., inner sleeve 50 cannot move longitudinally.

Figure 4:
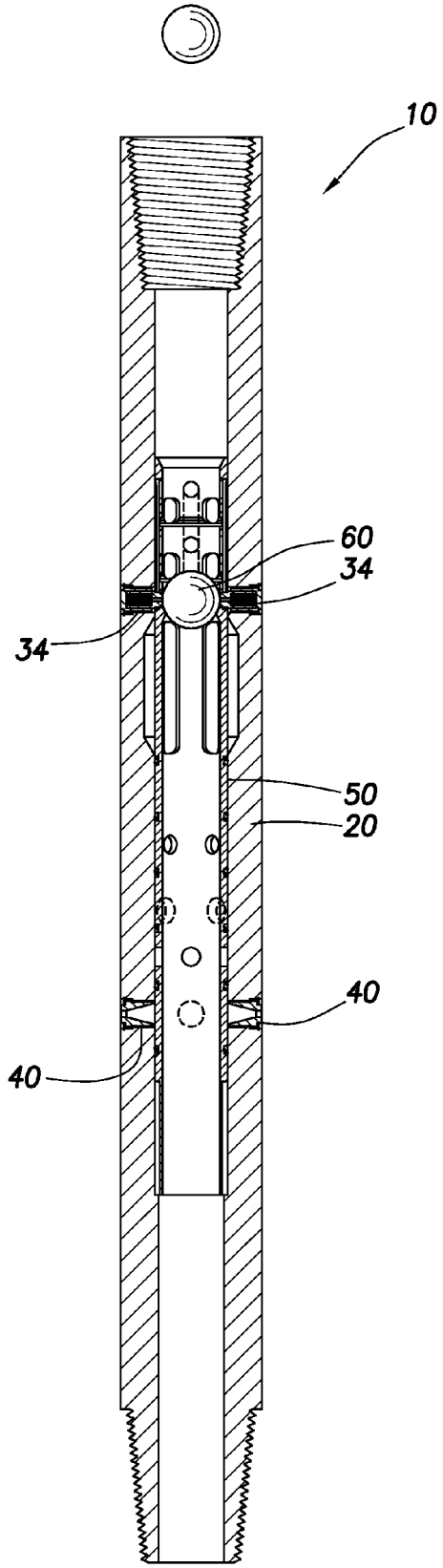
FIG. 4 is a sectional view of the bypass tool embodiment of FIG. 3 in the closed position with an actuation ball contacting the ball seat and depressing the detent.
Figure 10:
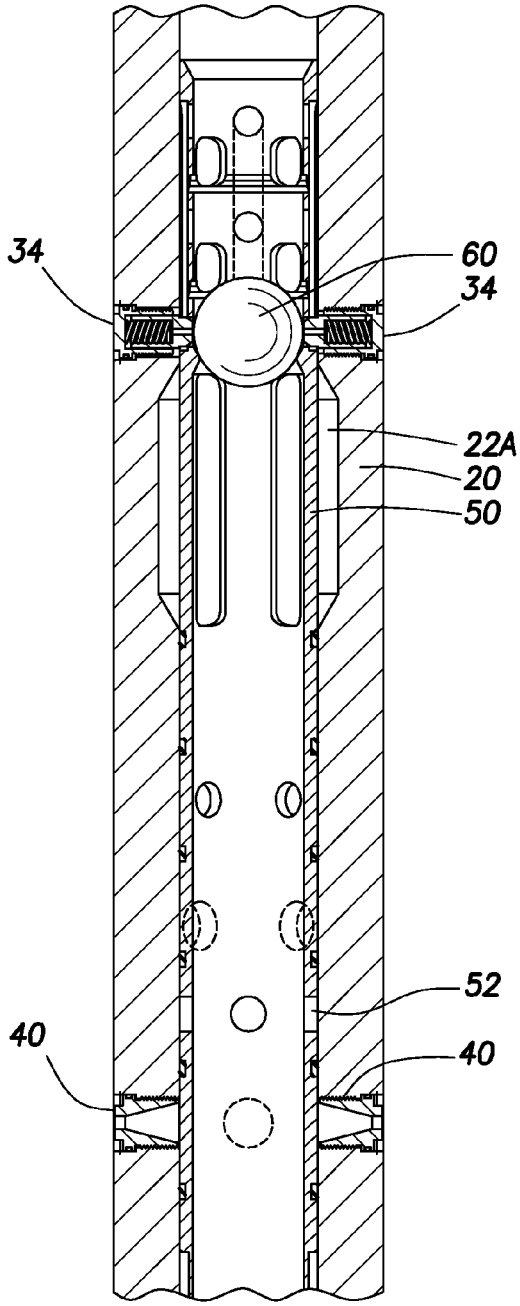
FIG. 10 is an enlarged, partial sectional view of the bypass tool embodiment of FIG. 3 in the closed position with an actuation ball contacting the ball seat and depressing the detent.

In FIGS. 4 and 10, the bypass tool 10 is illustrated with an activating member 60 (illustrated as a ball) in place on ball seat 56 in the bore of inner sleeve 50, but with inner sleeve 50 still in the circulation position. It is understood that activating member 60 and ball seat 56 are sized so as to obstruct flow when the member is on the seat. As can be seen in FIG. 4, activating member 60 pushes detent pins 34 radially outward a sufficient distance that angled nose sections 34A are within the detent pin receiving holes 58. As can be seen in FIG. 10, the about 30 to 45 degree taper on the ends of the pins preferably is axially longer than the wall thickness (about 1/16 inch to 1 inch) of the inner sleeve 50. Alternatively, the axial length of the taper of the pins is longer than the maximum clearance between actuation member 60 and the internal diameter of inner sleeve 50 at the pins. This clearance ranges from about ½ to ¼ of an inch. Thus, when the actuation member 60 deflects the pins outward, the tapered surface on the pins engages the tapered surface of the holes 58A-C.

Figure 5:
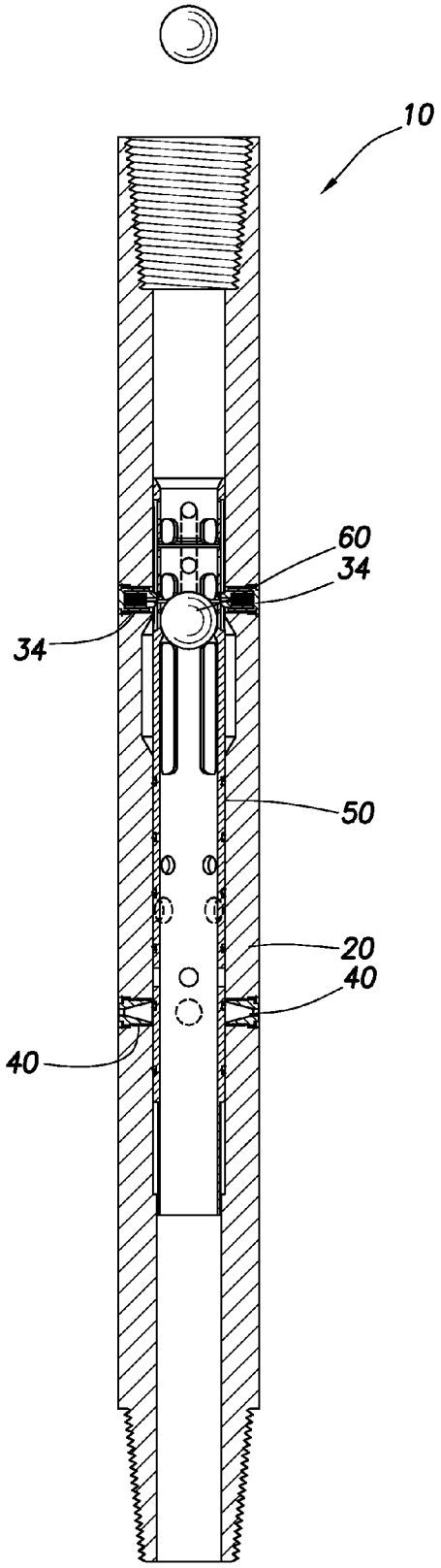
FIG. 5 is a sectional view of the bypass tool embodiment of FIG. 3 with the activating ball in place and the inner sleeve shifted downward toward the bypass position.
Figure 11:
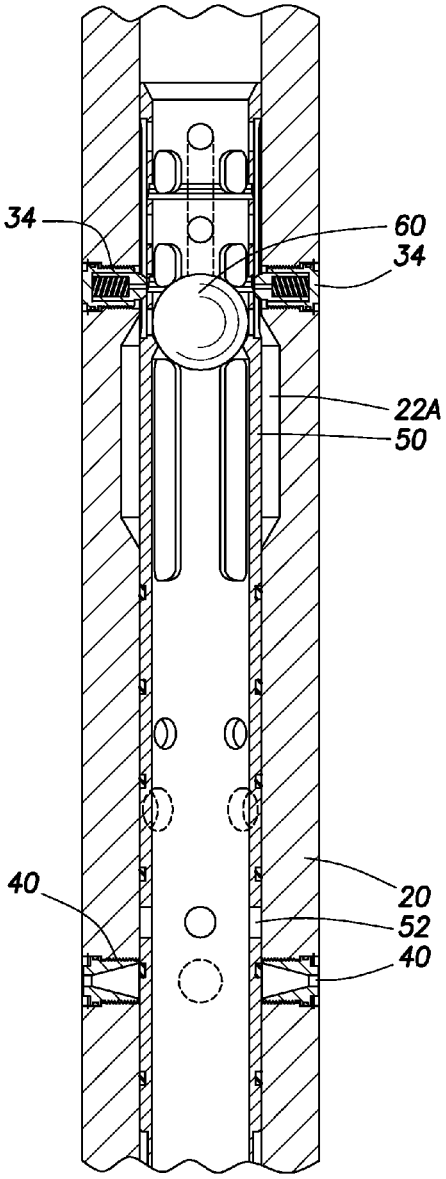
FIG. 11 is an enlarged, partial sectional view of the bypass tool embodiment of FIG. 3 with the activating ball in place and the inner sleeve shifted downward toward the bypass position.

FIGS. 5 and 11 illustrate inner sleeve 50 in an intermediate position, between the circulating and bypass positions. FIGS. 5 and 11 illustrate inner sleeve 50 pushed downward, due to fluid pressure imposed on activating member 60 (pressure applied at the surface, on the bore of the tubing string). Pressure acting on activating member 60 will force inner sleeve 50 downward which, in turn, will wedge or cam detent pins 34 further outward until they clear lower detent pin receiving holes 58A releasing the inner sleeve 50 to shift downward, as illustrated in FIGS. 5 and 11. The inner sleeve 50 will continue to shift downward to the circulating position where detent pins 34 engage middle detent pin receiving holes 58B as illustrated in FIGS. 6 and 12.

Figure 6:
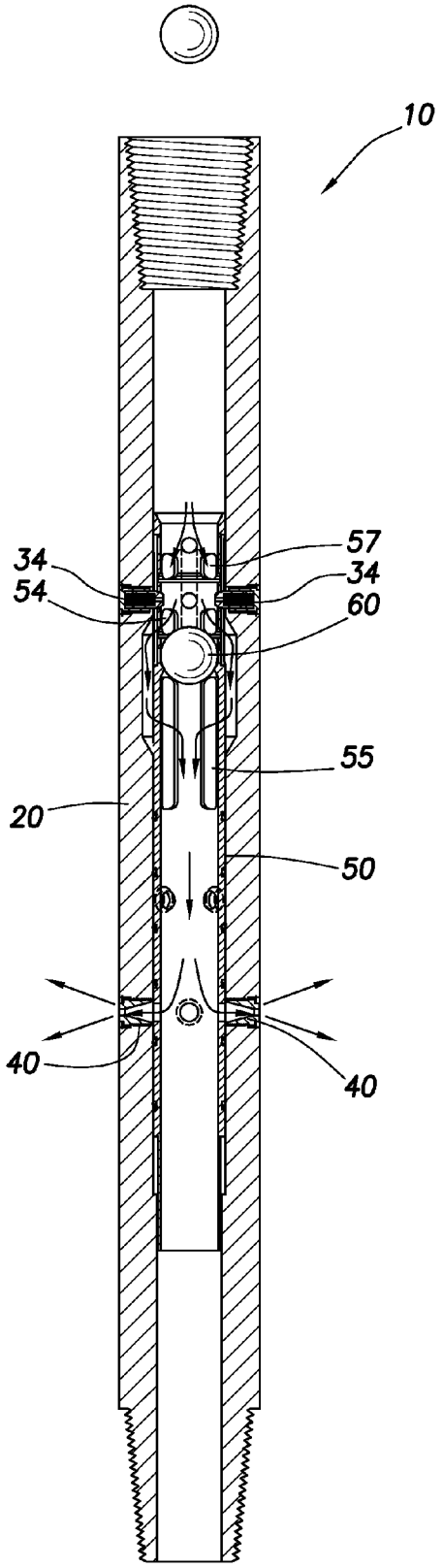
FIG. 6 is a sectional view of the bypass tool embodiment of FIG. 3 in the bypass position wherein ports in the body wall are open.
Figure 12:
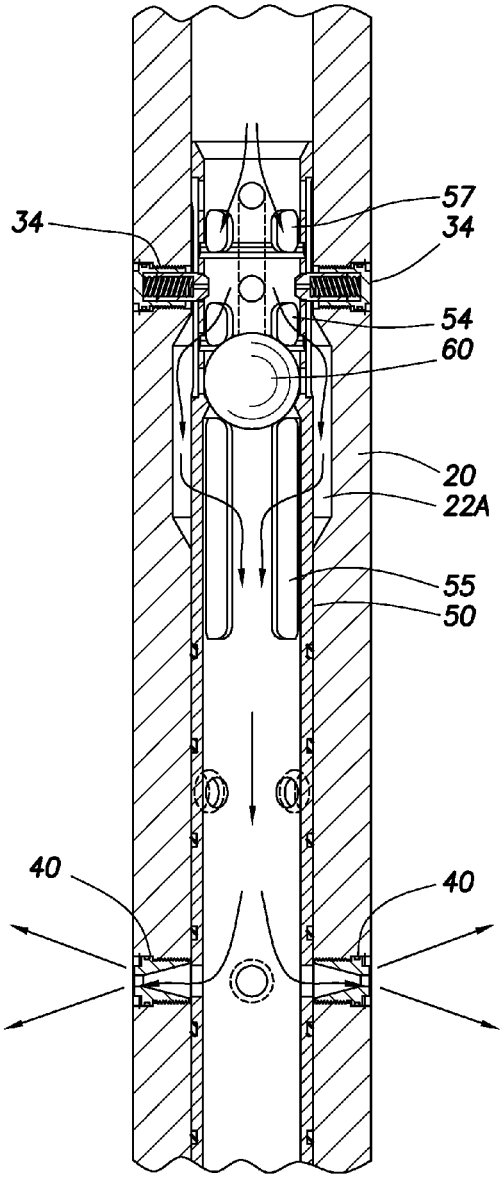
FIG. 12 is an enlarged, partial sectional view of the bypass tool embodiment of FIG. 3 in the bypass position wherein ports in the body wall are open.

In FIGS. 6 and 12, inner sleeve 50 has been shifted (pushed) downwardly into its bypass position. It can be seen that ports 52 are substantially aligned with ports 25 containing jets 40. Detent pins 34 are aligned with a second set of middle detent pin receiving holes 58B, snapping into those holes a sufficient distance for square shoulder section 34B to engage same, thereby positively holding inner sleeve 50 in the bypass position. Fluid flow path is as noted by the arrows in FIGS. 6 and 12; namely, with activating member 60 seated on and sealing ball seat 56, fluid cannot flow through the bore of inner sleeve 50, but is directed through slots 54 in inner sleeve 50 above activating member 60, into the annulus between inner sleeve 50 and enlarged bore section 22A, through slots 55 below activating ball 60 and back into the bore of inner sleeve 50, then down to and through ports 52 and jets 40. It is understood that a certain portion of the overall fluid flowstream will continue downhole through the tubing string bore. It is further understood that jets 40 can be removed or sized so as to yield a desired split of fluid flow between the bore of the tool (i.e. proceeding downhole) and the bypass.

Figure 7:
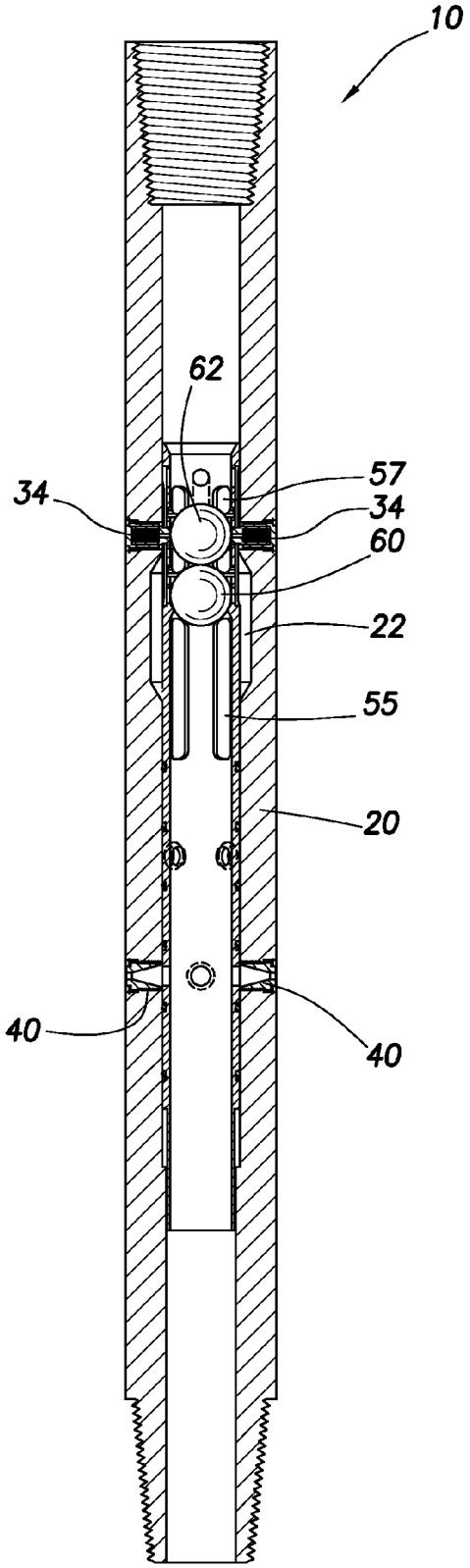
FIG. 7 is a sectional view of the bypass tool embodiment of FIG. 3 with a second activating ball depressing the detent freeing the inner sleeve to move down to a second closed position.
Figure 13:
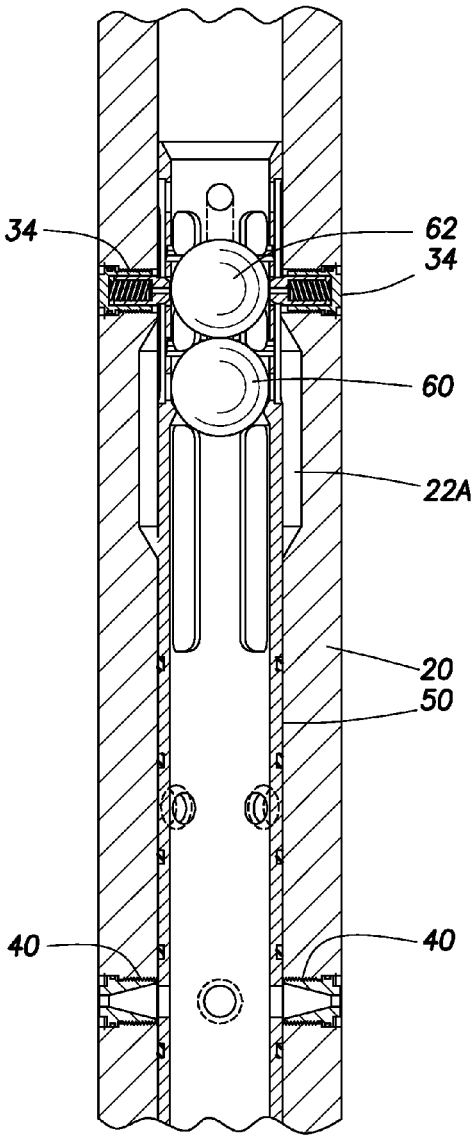
FIG. 13 is an enlarged, partial sectional view of the bypass tool embodiment of FIG. 3 with a second activating ball depressing the detent, freeing the inner sleeve to move down to a second closed position.

FIGS. 7 and 13 illustrate a second activating member 62 has been dropped through or pumped down the bore of the tubing string, to fall to and rest atop the first activating ball 60. It is noted that the activation members are illustrated as a balls of the same diameter. If other shapes of actuating members, such as a cylindrical member, are used, they need only have the same cross sectional size where the detents are engaged. As can be illustrated, the second activating member 60 pushes detent pins 34 radially outward a sufficient distance, such that, angled nose section 34A is within middle detent pin receiving holes 58B; therefore, inner sleeve 50 can be shifted downwardly, by caroming detent pins 34 further outward. Note that in FIGS. 7 and 13, inner sleeve 50 has not moved from the bypass position of FIGS. 6 and 12.

Figure 8:
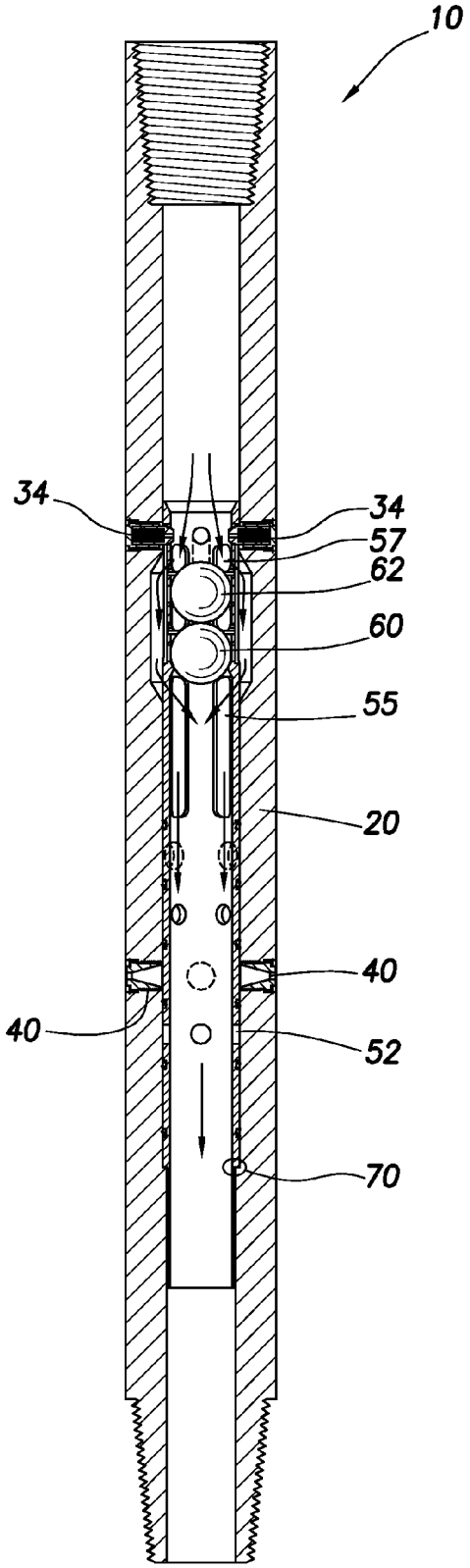
FIG. 8 is a sectional view of the bypass tool embodiment of FIG. 3 with the sleeve is in the second closed position with the ports blocked and wherein fluid is being pumped through the tubing string flows through the bypass tool.
Figure 14:
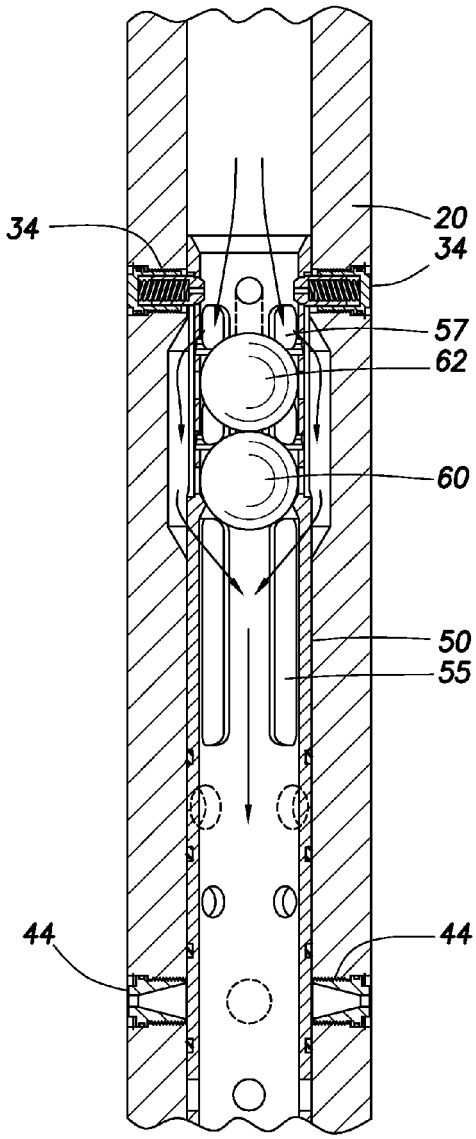
FIG. 14 is an enlarged, partial sectional view of the bypass tool embodiment of FIG. 3 with the sleeve in the second closed position with the ports blocked and wherein fluid pumped through the tubing string flows through the bypass tool.

FIGS. 8 and 14 illustrated fluid pressure acting on member 62 pushes inner sleeve 50 to its lowermost or second circulating position. In the illustrated embodiment, shoulders 70 prevent further axial movement of inner sleeve 50 and detent pins 34 snap into a top set of upper detent pin receiving holes 58C, thereby positively holding inner sleeve 50 in place. Ports 52 are misaligned with jets 40, thereby preventing fluid flow through the jets. The fluid flowpath is denoted by the arrows in FIGS. 8 and 14. Fluid flows from the tubing string into the bore of main body 20, through slots 57 in inner sleeve 50 above upper activating ball 60, through the annulus between inner sleeve 50 and enlarged bore section 22A; and back into the bore of inner sleeve 50 through slots 55 below the activating balls. Fluid can then continue to flow downhole through the bore of the tubing string.

According to the methods of the present inventions: (1) the bypass tool can be run into a wellbore 102 on a tubing string in the circulating or closed (non-bypass) position; (2) an activating member dropped; (3) the bypass tool shifted into a bypass position; (4) bypass fluid is flowed into the wellbore 102 from the bypass tool; (5) a second activating ball is dropped; and (6) the bypass tool is shifted back into a circulating position.

It is to be understood that the detent system permits movement of the inner sleeve between circulating and bypass positions, while retaining the inner sleeve positively in place when in one of these positions. Reverse (and forward) circulating is possible without concern for inadvertent shifting of the inner sleeve. In addition, it is to be noted that a large circulating area around the circulating ball exists (whether in forward or reverse circulating modes), minimizing any pressure drop in that section of the tool.

Figure 15:
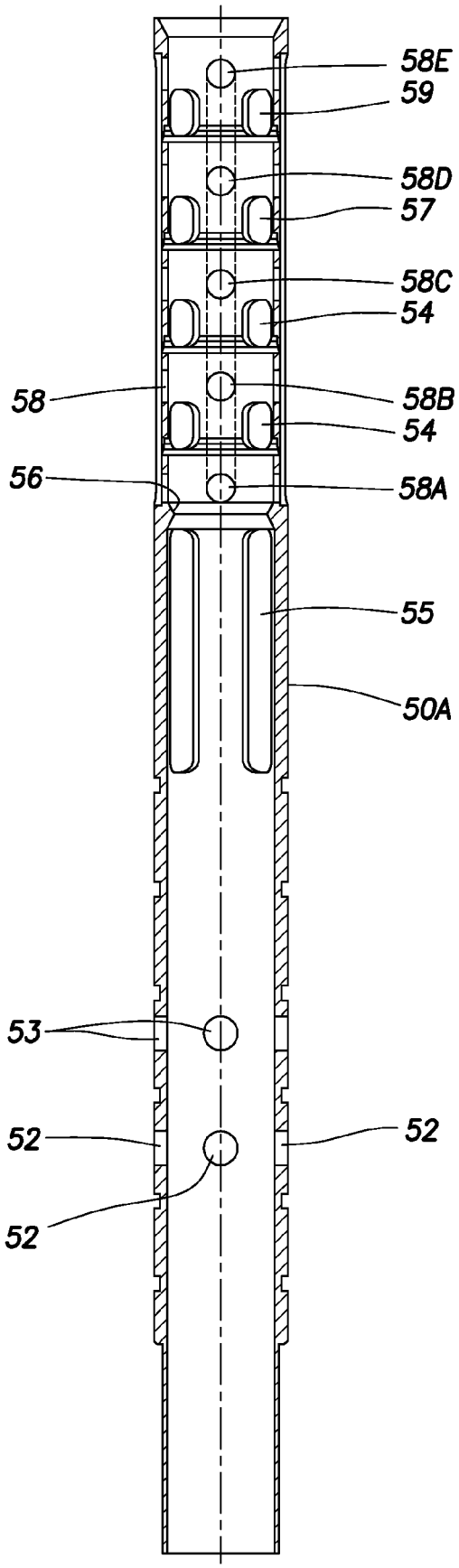
FIG. 15 is a sectional view of an alternative embodiment of the inner sleeve of the present inventions.

According to another aspect of the bypass tool of the present inventions, the inner sleeve can be constructed whereby the sleeve could be shifted into and out of the bypass position more than once. In this embodiment, the inner sleeve 50 is modified to accommodate the additional junction. For example, in FIG. 15, an embodiment of the alternative version inner sleeve is constructed so that it can be placed in the bypass position twice. Alternative version inner sleeve 50A, is extended in length and two additional detent pin receiving holes 58D and 58E are added above holes 58C. An additional set of bypass ports 53 are added above ports 52. Slots 57 and 59 are added above slots 56 as illustrated. In addition, the enlarged bore section 22A of the main body 20 may require lengthening from that shown in FIG. 1. To shift the tool from the circulation position illustrated in FIGS. 8 and 14, a third actuating member is dropped to displace the detent pins 34 from holes 58C. The sleeve is shifted down until the second set of bypass ports align 53 with jet ports 25 in the body and detent pins 34 snap into the first added set of detent pin receiving holes 58D. Bypass operations can then be performed. To return to the circulation position, a fourth activating member is dropped to depress the detent pins 34, allowing the inner sleeve shift downward to offset the second set of bypass ports 53 from the main body ports 25, thus closing off bypass flow. The detent pins 34 can engage the second added set of detent pin receiving holes 58E to lock the sleeve in the circulation position. Thus, by dropping two additional actuation members, the tool can be made to cycle into and out of the bypass position. As noted above, the actuation members in the illustrated embodiment are balls; all four of which are the same size. It is envisioned that additional ports and detent pin receiving holes could be added to allow the tool to cycle more than two times to the bypass position.

Figure 16:
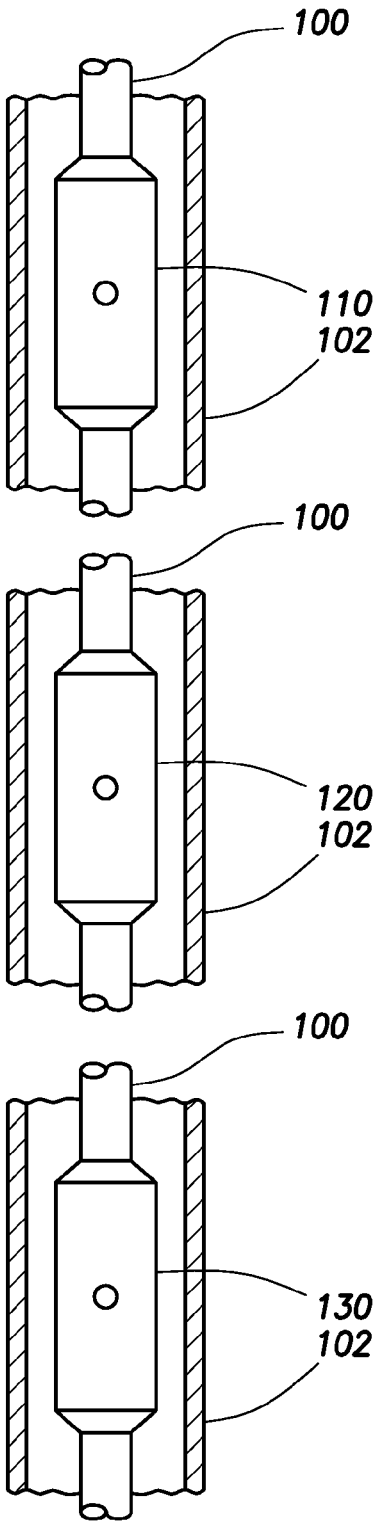
FIG. 16 is a schematic of a tubing configuration of an alternative embodiment of the present inventions.

FIG. 16 illustrates yet another embodiment of the bypass tools of the present inventions wherein two or more bypass tools are assembled in a tubing string. In FIG. 16, tubing string 100 is illustrated inserted in a wellbore 102. The tubing string 100 is assembled with multiple bypass tools. In the illustrated example, three separate and structurally different bypass tools 110, 120 and 130 are included in the string. It is envisioned that more or less could be included in the string, depending on the well. The seat on the inner sleeve of the upper bypass tool 110 is designed to be actuated by balls of 2.78 inches diameter but will allow actuation balls smaller than 2.78 inches in outer diameter to pass through the tool. The center bypass tool 120 is actuated by balls of 2.25 inches in diameter and allows smaller balls to pass through. The lower bypass tool 130 is actuated by balls of 1.75 inches in diameter. According to the method of use of these tools, the lower bypass tool is actuated first (moved to the bypass position and then closed when the bypass operation is completed) by dropping a 1.75 inch ball which passes through bypass tools 120 and 130 without actuating them. Next, the center bypass tool 120 is actuated using a 2.25 inch actuation ball. Thereafter, the upper bypass tool 110 is actuated using a 2.78 inch diameter actuation ball. By including in the string tools that are actuated by different size actuation members, multiple bypass operations can be performed.

While the preceding description contains many specificities, it is to be understood that same are presented only to describe some of the presently preferred embodiments of the inventions, and not by way of limitation. Changes can be made to various aspects of the inventions, without departing from the scope thereof, for example:

- the detent system may be held by either the outer body (as in the above illustrated embodiment) or by the inner sleeve, as long as the detent system controls relative movement between those two members;
- the detent pins may be biased by mechanical means such as springs, or by other means (e.g., hydraulic); dimensions and materials can be changed to suit particular situations; the tool can be run in conjunction with other downhole tools; and multiple bypass tools can be run together in a string, to yield multiple bypass/circulating cycles, etc.

Therefore, the scope of the inventions is not to be limited to the illustrative examples set forth above, but encompasses modifications which may become apparent to those of ordinary skill in the relevant art. While particular embodiments of the inventions have been shown and described, numerous variations and alternate embodiments will occur to those skilled in the art. Accordingly, it is intended that the inventions be limited only in terms of the appended claims.

The inventions may be embodied in other specific forms than the examples illustrated and described herein without departing from the spirit and scope of the present inventions as defined by the appended claims. The scope of the inventions is, therefore, indicated by the appended claims rather than by the foregoing description. All changes to the claims that come within the meaning and range of equivalency of the claims are to be embraced within their scope. Further, all published documents, patents, and applications mentioned herein are hereby incorporated for all purposes by reference, as if presented in their entirety.

What is claimed is:

1. A wellbore bypass tool adapted to be lowered into a wellbore on a tubing string and which is changeable between a circulation position which allows well fluids to flow through the tubing string and a bypass position wherein well fluids are injected into the annulus surrounding the bypass tool, the tool comprising:

- an elongated tubular body open at both ends with the ends adapted for connection to the tubing string, an interior fluid passage extending from the upstream end of the tubular member to the open lower end of the tubular member, bypass discharge ports in the wall of the tubular member extending between the interior fluid passage and the exterior of the tubular member;
- a sleeve having an interior fluid passage extending longitudinally therethrough and being mounted in the tubular member to move in the tubular member into and out of the bypass position permitting flow through the bypass discharge ports; and
- a pin mounted in the tubular body movable radially between a position engaging the sleeve to hold the sleeve in position against axial movement and a retracted position, permitting movement of the sleeve into and out of the bypass position.

2. The tool of claim 1, wherein a seat is present on the sleeve for receiving an actuation member.

3. The tool of claim 1, wherein the pin has a cam surface on the end of the pin engaging the sleeve.

4. The tool of claim 1, wherein the pin is resiliently urged into contact with the sleeve.

5. The tool of claim 1, wherein a coil spring resiliently urges the pin into contact with the sleeve.

6. The tool of claim 1, wherein the sleeve has a bypass port which when aligned with a bypass discharge port in the body allows fluid to flow through the bypass discharge port.

7. The tool of claim 1, wherein a plurality of spaced shoulders are provided on the sleeve for engagement by the pin.

8. The tool of claim 1, wherein the sleeve is mounted to shift axially in the body.

9. The tool of claim 1, wherein the sleeve has a plurality of bypass ports.

10. A wellbore bypass tool adapted to be lowered into a wellbore on a tubing string and which is changeable between a circulation position which allows well fluids to flow through the tubing string and a bypass position wherein well fluids are injected into the annulus surrounding the bypass tool, the tool comprising:

an elongated tubular body open at both ends with the ends adapted for connection to the tubing string, an interior fluid passage extending from the upstream end of the tubular member to the open lower end of the tubular member, bypass discharge ports in the wall of the tubular member extending between the interior fluid passage and the exterior of the tubular member;

a sleeve having an interior fluid passage extending longitudinally therethrough and being mounted in the tubular member to move in the tubular member into and out of the bypass position permitting flow through the bypass discharge ports; and a pin mounted in the tubular body movable radially between a position engaging the sleeve to hold the sleeve in position against axial movement and a retracted position, permitting movement of the sleeve into and out of the bypass position and wherein the pin extends into the interior of the sleeve a sufficient distance to engage an actuation member inserted in the sleeve interior passage.

11. The tool of claim 10, wherein the actuation member is a spherical ball.

12. The tool of claim 10, wherein the actuation member has the cross-sectional shape and size to fit tight in the sleeve interior passage.

13. The tool of claim 12, additionally comprising a seat on the sleeve and an actuation member engaging the seat to restrict fluid flow through the sleeve fluid passage and engaging the pin to disengage the pin from the sleeve.

14. A method for flowing fluid from a tubing string into the annulus surrounding the tubing string, the method comprising the steps of:

providing a bypass tool having a tubular body with an internal passageway open at both ends of the tool and a bypass passageway extending from the internal passageway to the exterior of the tool, a sleeve mounted in the internal passageway of the body to shift into positions blocking and opening the bypass passageway;

connecting the bypass tool to a tubing string with the internal passageway in fluid communication with the tubing sting and the sleeve blocking flow through the bypass passageway;

positioning the tubing string in the wellbore and pumping well fluids through the tubing string and the bypass tool;

thereafter, moving a first actuation member down the tubing string to the bypass tool to contact the sleeve and shift the sleeve to a position opening the bypass passageway;

flowing fluids through the bypass passageway and into the annulus surrounding the tool; and thereafter, moving a second actuation member of substantially the same cross-sectional shape and size as the first actuation member down the tubing string to the bypass tool to contact and shift the sleeve to a position blocking the bypass passageway.

15. The method of claim 14, wherein the two actuation members are spherical shaped and have the same diameter.

16. The method of claim 14, wherein the shifting step additionally comprises using the balls to move spring-loaded pins out of contact with the sleeve to allow the sleeve to shift.

17. The method of claim 14, additionally comprising providing a tool with a seat on the sleeve of a size and shape to mate with the first actuating member.

18. The method of claim 14, additionally comprising passing the fluid flowing through the bypass passageway through one or more nozzles.

19. The method of claim 14, wherein the step of opening a bypass passageway comprises disengaging a movable detent pin, holding the sleeve in place.

20. The method of claim 14, additionally comprising thereafter, moving an additional actuation member of substantially the same cross-sectional shape and size as the first and second actuation members down the tubing string to the bypass tool to contact and additionally shift the sleeve into a position reopening opening the bypass passageway; and thereafter, flowing fluids through the bypass passageway and into the annulus, surrounding the tool.

* * * * *